US007826594B2

(12) United States Patent
Zou et al.

(10) Patent No.: US 7,826,594 B2
(45) Date of Patent: Nov. 2, 2010

(54) VIRTUAL MATRIX CONTROL SCHEME FOR MULTIPLE SPOT X-RAY SOURCE

(75) Inventors: Yun Zou, Clifton Park, NY (US); Mark E. Vermilyea, Niskayuna, NY (US); Louis Paul Inzinna, Scotia, NY (US); Antonio Caiafa, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 92 days.

(21) Appl. No.: 12/113,726

(22) Filed: May 1, 2008

(65) Prior Publication Data

US 2009/0185661 A1 Jul. 23, 2009

Related U.S. Application Data

(63) Continuation-in-part of application No. 12/017,098, filed on Jan. 21, 2008.

(51) Int. Cl.
*H05G 1/08* (2006.01)
*H01J 35/06* (2006.01)

(52) U.S. Cl. ..... 378/92; 378/9; 378/10; 378/122; 378/136; 378/138

(58) Field of Classification Search ..... 378/9, 378/10, 92, 122, 124, 134; 313/495, 496, 313/497

See application file for complete search history.

(56) References Cited

U.S. PATENT DOCUMENTS 4,521,901 A 6/1985 Rand
5,959,400 A * 9/1999 Niigaki et al. ..... 313/495
6,233,309 B1 * 5/2001 Baptist ..... 378/92
6,259,765 B1 * 7/2001 Baptist ..... 378/136
6,333,968 B1 * 12/2001 Whitlock et al. ..... 378/136
6,385,292 B1 * 5/2002 Dunham et al. ..... 378/122
6,456,691 B2 * 9/2002 Takahashi et al. ..... 378/122
6,553,096 B1 4/2003 Zhou et al.
6,674,837 B1 * 1/2004 Taskar et al. ..... 378/122

(Continued)

OTHER PUBLICATIONS

Liu et al., "Development of a carbon nanotube based microfocus x-ray tube with single focusing electrode," Review of Scientific Instruments 77, 054302, pp. 1-6, 2006, http://rsi.aip.org/rsi/copyright.jsp.

(Continued)

*Primary Examiner*—Allen C. Ho
(74) *Attorney, Agent, or Firm*—Jason K. Klindtworth

(57) ABSTRACT

A system and method for addressing individual electron emitters in an emitter array is disclosed. The system includes an emitter array comprising a plurality of emitter elements arranged in a non-rectangular layout and configured to generate at least one electron beam and a plurality of extraction grids positioned adjacent to the emitter array, each extraction grid being associated with at least one emitter element to extract the at least one electron beam therefrom. The field emitter array system also includes a plurality of voltage control channels connected to the plurality of emitter elements and the plurality of extraction grids such that each of the emitter elements and each of the extraction grids is individually addressable. In the field emitter array system, the number of voltage control channels is equal to the sum of a pair of integers closest in value whose product equals the number of emitter elements.

18 Claims, 9 Drawing Sheets

U.S. PATENT DOCUMENTS 6,731,716 B2 * 5/2004 Mihara et al. ..... 378/9
6,760,407 B2 * 7/2004 Price et al. ..... 378/122
6,807,248 B2 * 10/2004 Mihara et al. ..... 378/10
6,876,724 B2 4/2005 Zhou et al.
7,085,352 B2 * 8/2006 Dunham ..... 378/122
7,192,031 B2 * 3/2007 Dunham et al. ..... 278/122
7,295,651 B2 * 11/2007 Delgado et al. ..... 378/92
2005/0175151 A1 8/2005 Dunham et al.

OTHER PUBLICATIONS

Lalush et al., "Tomosynthesis Reconstruction From Multi-Beam X-Ray Sources," IEEE, pp. 1180-1183, 2006.

* cited by examiner

VIRTUAL MATRIX CONTROL SCHEME FOR MULTIPLE SPOT X-RAY SOURCE

CROSS-REFERENCE TO RELATED APPLICATIONS

The present invention is a continuation-in-part of and claims the benefit of U.S. Ser. No. 12/017,098, filed on Jan. 21, 2008, the disclosure of which is incorporated herein by reference.

BACKGROUND OF THE INVENTION

The present invention relates generally to field-type electron emitters, and, more particularly, to a system for addressing individual electron emitters in an emitter array. A field emitter unit includes a protection and focusing scheme that functions to minimize degradation of the electron beam and allow for focusing of the electron beam into a desired spot size. A control system is provided that allows for individual control of field emitter units in an array with a minimum amount of control channels.

Electron emissions in field-type electron emitter arrays are produced according to the Fowler-Nordheim theory relating the field emission current density of a clean metal surface to the electric field at the surface. Most field-type electron emitter arrays generally include an array of many field emitter devices. Emitter arrays can be micro- or nano-fabricated to contain tens of thousands of emitter devices on a single chip. Each emitter device, when properly driven, can emit a beam or current of electrons from the tip portion of the emitter device. Field emitter arrays have many applications, one of which is in field emitter displays, which can be implemented as a flat panel display. In addition, field emitter arrays may have applications as electron sources in microwave tubes, x-ray tubes, and other microelectronic devices.

The electron-emitting field emitter devices themselves may take a number of forms, such as a "Spindt"-type emitter. In operation, a control voltage is applied across a gating electrode and substrate to create a strong electric field and extract electrons from an emitter element placed on the substrate. Typically, the gate layer is common to all emitter devices of an emitter array and supplies the same control or emission voltage to the entire array. In some Spindt emitters, the control voltage may be about 100V. Other types of emitters may include refractory metal, carbide, diamond, or silicon tips or cones, silicon/carbon nanotubes, metallic nanowires, or carbon nanotubes.

When used as an electron source in an x-ray tube application, field emitter arrays create challenges regarding the addressability and activation of each field emitter. That is, in existing designs of field emitter arrays, each of the emitters in the array is addressed in turn via an associated bias or activation line and at appropriate time intervals. Due to the large number of emitter elements in a typical array, there can exist an equally large quantity of associated activation lines and connections. The large number of activation lines need to pass through the vacuum chamber of the x-ray tube to supply the emitter elements, thus there necessitates a large number of vacuum feedthroughs. There is an unavoidable leak rate associated with any feedthrough device, which can lead to gas pressure levels in the tube that can inhibit performance of the emitter elements and their ability to generate electrons.

Additionally, it may be desired for the field emitters in the array to be arranged in one of many varying orientations. That is, depending on the specific application, the field emitters may not always be arranged in a "matrix" type orientation (e.g., a 3×3 matrix/array of emitters), but may also be arranged in a linear array or in different patterns. Such patterns and arrangements can cause additional challenges with respect to the connection of each field emitter to an associated activation line and connection.

Thus, a need exists for a system for controlling the emitter elements in an emitter array that reduces the number of activation lines and feedthrough channels. It would also be desirable for such a system to be able to operate independent of the physical topology of the emitter elements in the emitter array.

BRIEF DESCRIPTION OF THE INVENTION

Embodiments of the invention overcome the aforementioned drawbacks by providing a virtual matrix arrangement and addressing scheme for activation of individual field emitter units in an array. The field emitter units are addressed/activated via a virtual matrix scheme such that a minimum number of voltage control channels are needed to individual address/activate field emitter units in the array.

According to one aspect of the invention, a field emitter array system includes an emitter array comprising a plurality of emitter elements arranged in a non-rectangular layout and configured to generate at least one electron beam and a plurality of extraction grids positioned adjacent to the emitter array, each extraction grid being associated with at least one emitter element to extract the at least one electron beam therefrom. The field emitter array system also includes a plurality of voltage control channels connected to the plurality of emitter elements and the plurality of extraction grids such that each of the emitter elements and each of the extraction grids is individually addressable. In the field emitter array system, the number of voltage control channels is equal to a sum of a pair of integers closest in value whose product equals the number of emitter elements.

According to another aspect of the invention, a multiple-spot electron beam generator includes a plurality of emitter groups that are linearly arranged, with each emitter group including a plurality of emitter elements. The multiple-spot electron beam generator also includes at least one extraction grid associated with, and positioned adjacent to, each emitter group and configured to extract an electron beam from at least one of the plurality of emitter elements associated therewith and a plurality of control channels coupled to the plurality of emitter elements and to the extraction grids associated with the emitter groups. The plurality of control channels includes a plurality of emitter control channels configured to deliver an emitter voltage, each emitter control channel connected to an emitter element from each of the plurality of emitter groups. The plurality of control channels also includes a plurality of grid control channels configured to deliver an extraction voltage, wherein each grid control channel corresponds to a respective emitter group and is connected to the at least one extraction grid adjacent to each emitter group. The quantity of emitter control channels and grid control channels is equal to a sum of a pair of integers having a minimum difference therebetween and whose product equals the number of emitter elements.

According to yet another aspect of the invention, a distributed x-ray source for an imaging system includes a plurality of electron generators configured to emit at least one electron beam therefrom, with each electron generator comprising an emitter element and an extraction grid. The distributed x-ray source also includes a plurality of control circuits electrically connected to the plurality of electron generators such that each electron generator is connected to a pair of the control circuits to receive voltages therefrom, wherein a first control circuit of the pair of the control circuits is electrically connected to the emitter element and a second control circuit of the pair of control circuits is electrically connected to the extraction grid. The distributed x-ray source further includes a shielded anode positioned in a path of the at least one electron beam and configured to emit a beam of high-frequency electromagnetic energy conditioned for use in a CT imaging process when the electron beam impinges thereon. The number of control circuits in the distributed x-ray source is equal to a sum of a pair of integers closest in value whose product equals the number of emitter elements.

These and other advantages and features will be more readily understood from the following detailed description of preferred embodiments of the invention that is provided in connection with the accompanying drawings.

BRIEF DESCRIPTION OF THE DRAWINGS

The drawings illustrate embodiments presently contemplated for carrying out the invention.

In the drawings.

DETAILED DESCRIPTION OF THE INVENTION

The operating environment of embodiments of the invention is described with respect to an x-ray source or generator that includes a field emitter based cathode and/or an array of such field emitters. That is, the protection, focusing, and activation schemes of the invention are described as being provided for a field emitter based x-ray source. However, it will be appreciated by those skilled in the art that embodiments of the invention for such protection, focusing, and activation schemes are equally applicable for use with other cathode technologies, such as dispenser cathodes and other thermionic cathodes. The invention will be described with respect to a field emitter unit and arrays of such field emitters, but is equally applicable with other cold cathode and/or thermionic cathode structures.

Figure 1:
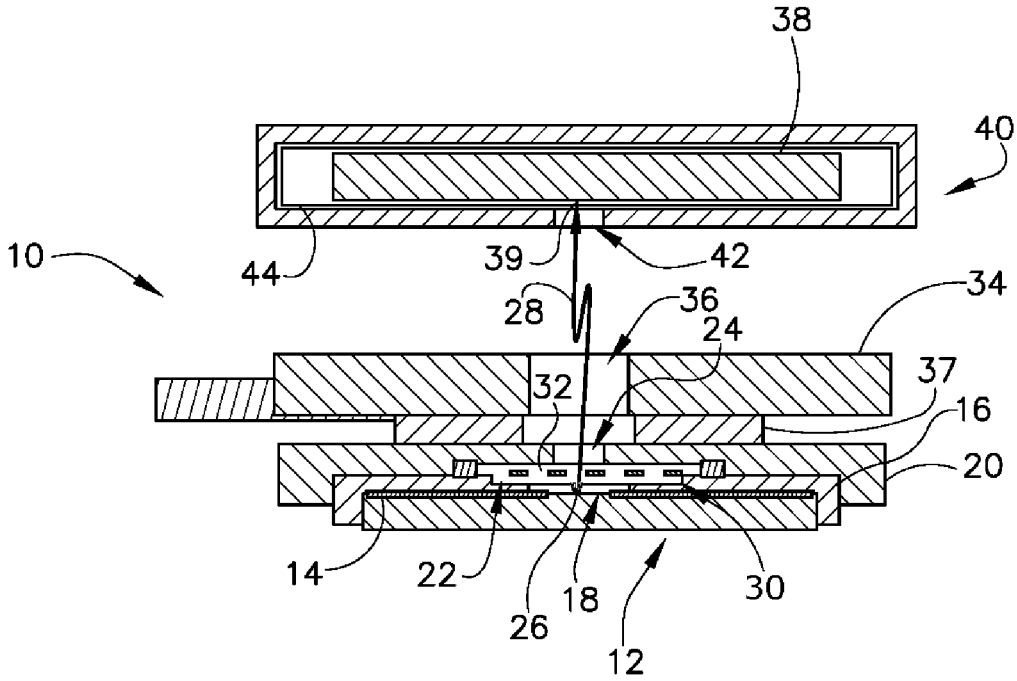
FIG. 1 is a cross-sectional view of a field emitter unit and target anode in accordance with an embodiment of the present invention.

Referring to FIG. 1, a cross-sectional view of a single electron generator 10 is depicted according to one embodiment of the invention. As will be explained in greater detail below, in one embodiment electron generator 10 is a cold cathode, carbon nanotube (CNT) field emitter, though it is understood that the features and adaptations described herein are also applicable to other types of field emitters, such as Spindt-type emitters, or other thermionic cathode or dispenser cathode type electron generators. As shown in FIG. 1, an electron generator comprises a field emitter unit 10 having a base or substrate layer 12 that is preferably formed of a conductive or semiconductive material such as a doped silicon-based substance or of copper or stainless steel. Therefore, substrate layer 12 is preferably rigid. A dielectric film 14 is formed or deposited over substrate 12 to separate an insulating layer 16 (i.e., ceramic spacer) therefrom. Dielectric film 14 is preferably formed of a non-conductive substance or a substance of a very high electrical resistance, such as silicon dioxide ($SiO_2$) or silicon nitride (Si3N4), or some other material having similar dielectric properties. A channel or aperture 18 is formed in dielectric film 14, by any of several known chemical or etching manufacturing processes.

Substrate layer 12 is registered onto insulating layer 16, which in one embodiment is a ceramic spacer element having desired insulating properties as well as compressive properties for absorbing loads caused by translation of the field emitter unit (e.g., when the field emitter unit forms part of an x-ray source that rotates about a CT gantry). Insulating layer 16 is used to separate the substrate layer 12 from an extraction electrode 20 (i.e., gate electrode, gate layer), so that an electrical potential may be applied between extraction electrode 20 and substrate 12. A channel or cavity 22 is formed in insulating layer 16, and a corresponding opening 24 is formed in extraction electrode 20. As shown, opening 24 substantially overlaps cavity 22. In other embodiments, cavity 22 and opening 24 may be of approximately the same diameter, or cavity 22 may be narrower than opening 24 of gate layer extraction electrode 20.

An electron emitter element 26 is disposed in cavity 22 and affixed on substrate layer 12. The interaction of an electrical field in opening 24 (created by extraction electrode 20) with the emitter element 26 generates an electron beam 28 that may be used for a variety of functions when a control voltage is applied to emitter element 26 by way of substrate 12. In one embodiment, emitter element 26 is a carbon nanotube based emitter; however, it is contemplated that the system and method described herein are also applicable to emitters formed of several other materials and shapes used in field-type emitters.

As shown in FIG. 1, the ceramic piece forming insulating layer 16 is formed to have a feature for suppressing surface flashover along the ceramic piece. In one embodiment, insulating layer 16 is formed to have one or more steps 30 around cavity 22. The stepped configuration 30 of the ceramic spacer 16 around cavity 22 helps suppress the surface flashover and protect emitter element 26. It is envisioned that emitter element 26 could be further protected by increasing a thickness of insulating layer 16 to further recess the emitter element 26 within cavity 22. Other methods for improving a voltage withstand capability of ceramic spacer 16 are also envisioned and include coating the spacer with a low secondary electron emissive coating or pre-treating the spacer surface with a low pressure plasma under high frequency in an inert gas environment.

Referring still to FIG. 1, a meshed grid 32 is positioned between cavity 22 and opening 24 of insulating layer 16 and extraction electrode 20, respectively. This positions meshed grid 32 in proximity to emitter element 26 to reduce the voltage needed to extract electron beam 28 from emitter element 26. That is, for efficient extraction, a gap between meshed grid 32 and emitter element 26 is kept within a desired distance (e.g., 0.1 mm-2 mm) in order to enhance the electric field around emitter element 26 and minimize the total extracting voltage necessary to extract electron beam 28. Placement of meshed grid 32 over cavity 22 allows for an extraction voltage applied to extraction electrode 20 in the range of approximately 1-3 kV, depending on the distance between meshed grid 32 and emitter element 26. By reducing the total extracting voltage to such a range, high voltage stability of field emitter unit 10 is improved and higher emission current in electron beam 28 is inherently made possible. The difference in potential between emitter element 26 and extraction electrode 20 is minimized to reduce high voltage instability in emitter unit 10 and simplify the need for complicated driver/control design therein.

A focusing electrode 34 is also included in field emitter unit 10 and is positioned above extraction electrode 20 to focus electron beam 28 as it passes through an aperture 36 formed therein. The size of aperture 36 and thickness of focusing electrode 34 are designed such that maximum electron beam compression can be achieved. As shown in FIG. 1, focusing electrode 34 is separated from extraction electrode 20 by a second ceramic spacer element 37. A voltage is applied to focusing electrode 34 to focus electron beam 28 by way of an electrostatic force such that the electron beam 28 is focused to form a desired focal spot 39 on a target anode 38. Additionally, focusing electrode 34 is configured such that it protects emitter element 26 from high voltage breakdown. That is, focusing electrode 34 helps to prevent an electrical breakdown of the emitter element 26, dielectric film 14, and insulating layer 16 and prevent the formation of an electric spark or electric arc (i.e., flashover) through such components that may, in part, result from ion back-bombardment generated from target anode 38, as will be explained in further detail below.

As set forth above, focusing electrode 34 functions to focus electron beam 28 into a desired focal spot 39 on target anode 38. As shown in FIG. 1, target anode 38 is housed within an anode shield 40 positioned thereabout. Anode shield 40 includes an opening 42 therein to allow electron beam 28 to pass through anode shield 40 and strike target anode 38. Upon the striking of the electron beam 28 on target anode 38, ions are generated via ionization of desorbed gases. As emitter element 26 is preferably operated at the ground potential and target anode 38 is operated at the full voltage potential, these positive ions attempt to travel backwards toward emitter element 26, which would cause damage to the emitter element 26. Anode shield 40 acts to trap the ions generated from target anode 38, thus preventing back-bombarding of the emitter element 26. Ion back-bombardment may also trigger high voltage arcing between field emitter and high potential anode. Therefore, placement of anode shield 40 about target anode 38 can also improve the high voltage stability of field emitter unit 10 by preventing high voltage arcing.

Anode shield 40 can also intercept electrons backscattered from anode surface. Without such shield, most of these backscattered electrons leave the surface of the target with a large proportion of their original kinetic energy and will return to the anode at some distance from the focal spot producing off-focal radiation. Therefore, anode shield 40 can improve the image quality by reducing off-focal radiation.

Inception of the backscattering electrons with anode shield 40 can also improve the thermal management of the target by preventing them from back striking the target. Such anode shield 40 can be liquid cooled.

Anode shield 40 can also be constructed to provide partial x-ray shielding by coating the anode with a high Z material 44 (i.e., a high atomic number material, such as tungsten) on an inner surface of anode shield 40. Placement of anode shield 40 about target anode 38 can also improve the high voltage stability of field emitter unit 10 and help prevent high voltage arcing. As target shield 40 is positioned very close to target anode 38, it is possible to reduce the material needed for x-ray shielding, thus reducing the total weight of an x-ray source (shown in FIGS. 10 and 11) incorporating field emitter unit 10 and target anode 38 and allowing for positioning of the x-ray source onto a rotating CT gantry (shown in FIGS. 10 and 11).

Figure 2:
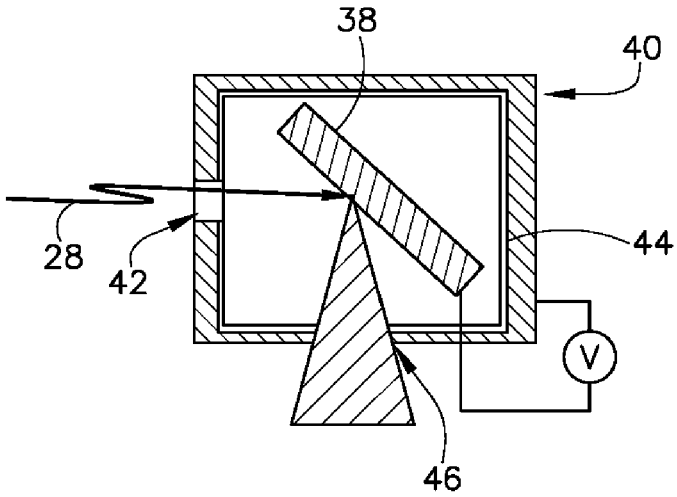
FIG. 2 is a schematic view of a target anode and target shield in accordance with an embodiment of the present invention.

As shown in FIG. 2, in another embodiment, target anode 38 is biased relative to anode shield 40 to improve the ion trapping. That is, ions generated upon the striking of electron beam 28 on target anode 38 are deflected off at angle relative to the incoming electron beam 28 and opening 42, thus preventing a majority of the ions from escaping from anode shield 40. The target anode 38 can be tilted such that electron beam 28 strikes target anode 38 with an angle of incidence of approximately between 10 to 90 degrees. Thus, for example, target anode 38 can be tilted by around 20 degrees with respect to the path of electron beam 28 to provide for adequate deflection of the generated ions. The x-rays generated by electron beam striking target anode exit anode shield 40 through a viewing window 46.

Figure 3:
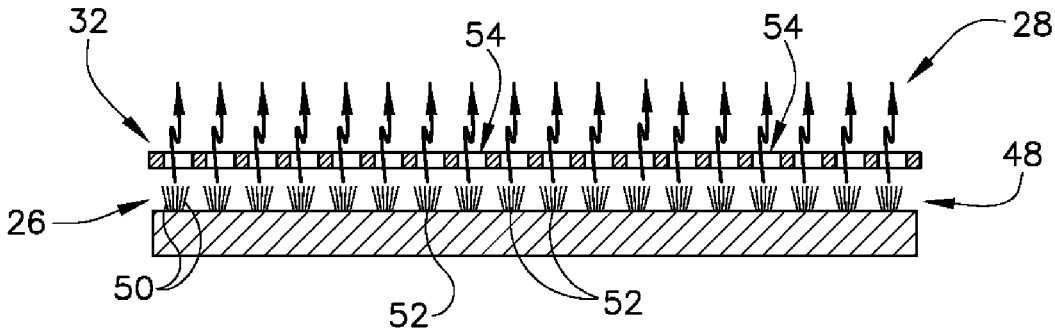
FIG. 3 is a partial cross-sectional view of a field emitter unit in accordance with an embodiment of the present invention.

Referring now to FIG. 3, in another embodiment, emitter element 26 is comprised of a plurality of macro emitters 48. As shown in FIG. 3, macro emitters 48 are comprised of a plurality of carbon nanotubes (CNTs) 50. To reduce the attenuation of electron beam 28 caused by the striking of electrons against meshed grid 32, CNTs 50 are patterned into multiple CNT groups 52 that are aligned with openings 54 in meshed grid 32. By aligning CNT groups 52 with openings 54 in meshed grid 32, interception of beam current in electron beam 28 can be reduced to almost zero, depending on the meshed grid structure. Also, by aligning CNT groups 52 with openings 54, a substantially higher fraction of electrons will pass through the meshed grid 32, thus increasing the total beam emission current and allowing for optimal focusing of electron beam 28 for forming a desired focal spot, as set forth above. The reduction of electron interception by the grid also reduces the heating of the grid, thus improving the grid life. Further, the reduction of electron interception on the grid also alleviates the loading on the driving circuits (not shown).

Figure 4:
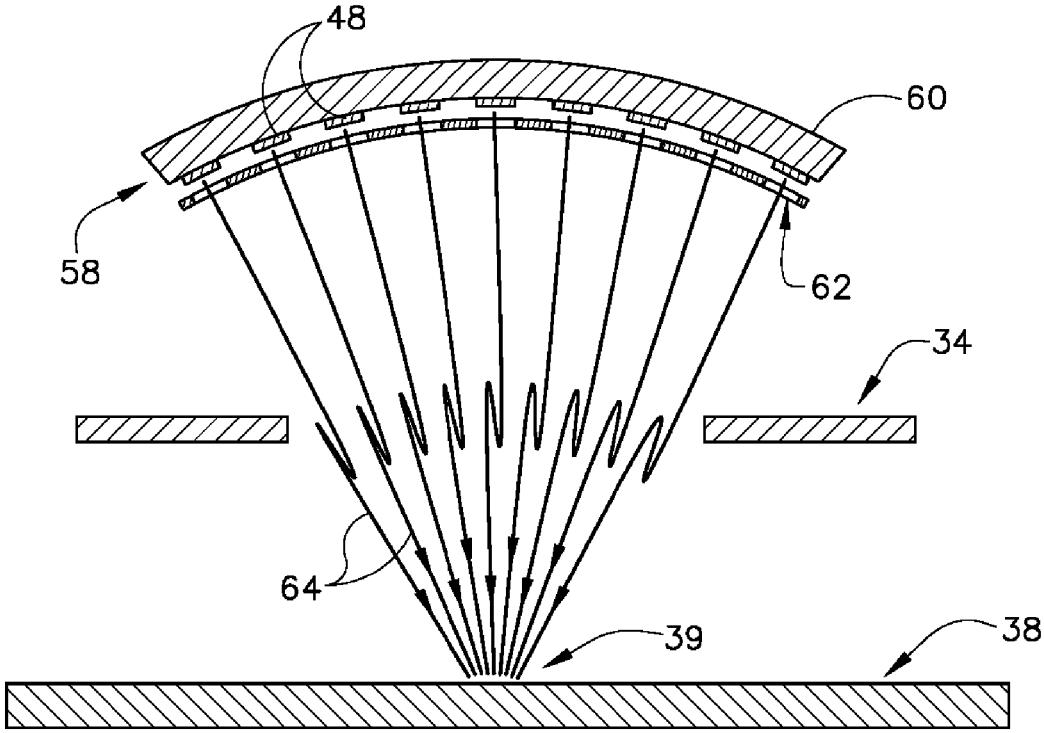
FIG. 4 is a partial cross-sectional view of a field emitter unit in accordance with another embodiment of the present invention.

In another embodiment, and as shown in FIG. 4, field emitter unit 10 is provided in a curved configuration to further increase focusing capability. Field emitter unit 10 is depicted in a partial cross-sectional view to illustrate a curvature 58 thereof. As shown, a substrate layer 60 and an extraction electrode/meshed grid 62 are curved such that electron streams 64 from multiple macro emitters 48 tend to converge. Preferably, curvature 58 may be concave and chosen to cause a desired convergence or focusing of the electron streams into a desired focal spot size on target anode 38. As known in the art, varying the area of the anode 38 on which an electron current impinges (i.e., focal spot 39) varies characteristics of the resulting x-ray beam. It is understood that, while only a single field emitter unit 10 is shown, curvature 58 may extend across multiple rows of emitters in a field emitter array (not shown) and that such an array may be curved across more than one dimension.

Figure 5:
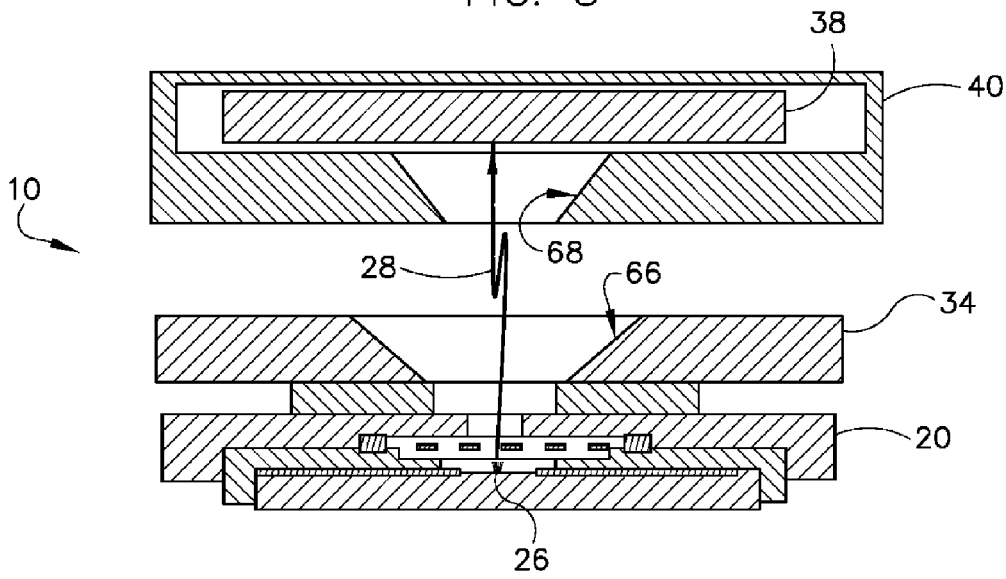
FIG. 5 is a cross-sectional view of a field emitter unit and target anode in accordance with another embodiment of the present invention.
Figure 6:
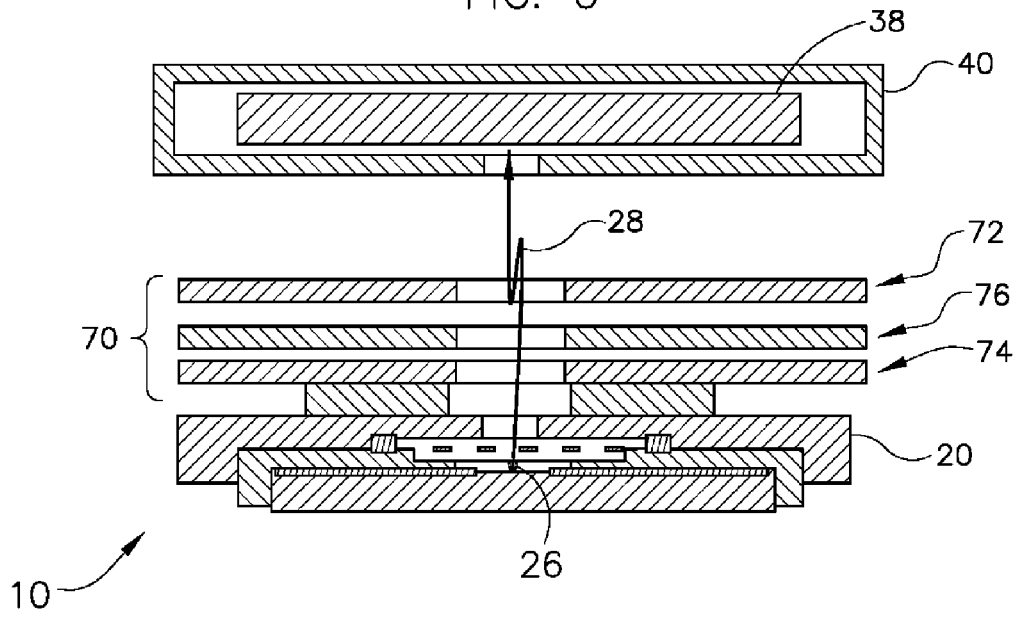
FIG. 6 is a cross-sectional view of a field emitter unit and target anode in accordance with another embodiment of the present invention.
Figure 7:
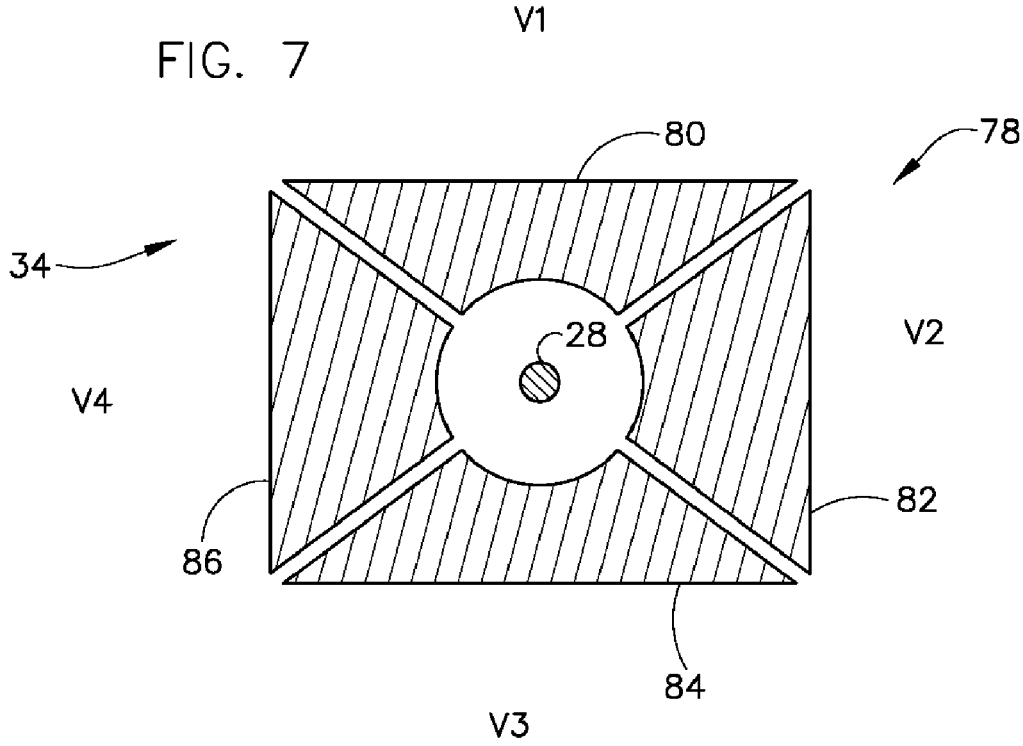
FIG. 7 is a top view of a focusing electrode in accordance with an embodiment of the present invention.

Referring now to FIGS. 5-7, focusing electrode 34 is shown in several embodiments that provide desired electron beam focusing in field emitter unit 10. As shown in FIG. 5, in one embodiment, focusing electrode 34 includes an angled aperture 66 formed in the electrode to provide a focusing angle for electron beam 28. The aperture 66 can be angled at the Pierce angle (i.e., 67.5 degrees) or other suitable angles to provide desired electron beam focusing. Additionally, opening 42 in anode shield 40 can be formed to have a focusing angle 68 to further improve the electron beam focusing.

In another embodiment, and as shown in FIG. 6, the focusing electrode comprises an Einzel lens 70. The Einzel lens 70 is constructed of three electrodes 72, 74, 76, with the outer two electrodes 72, 74 having a first potential and the middle electrode 76 having a second and different potential. Each of the three electrodes 72, 74, 76 are cylindrical or rectangular in shape and are arranged in series along an axis corresponding to the path of the electron beam 28. The electrodes 72, 74, 76 manipulate the electric field to deflect electron beam 28 as it passes therethrough. The electrodes 72, 74, 76 are symmetric so electron beam 28 will regain its initial speed on exiting the Einzel lens 70, although the velocity of outer particles in the electron beam will be altered such that they converge onto the axis/path of travel of electron beam 28, thus focusing the beam. While Einzel lens 70 is shown as being comprised of three electrodes 72, 74, 76, it is also envisioned that additional electrodes may be used. Further, a variation of the Einzel lens could also use assymetric voltage on the first and third electrodes.

For certain advanced CT applications, it is desirable to have electron beam wobbling capability. Thus, as shown in the embodiment of FIG. 7, the focusing electrode is configured as a split lens 78 including four segments 80, 82, 84, 86. Each segment 80, 82, 84, 86 has a different voltage applied thereto (V1, V2, V3, V4) to form a combined dipole and quadrupole field. The dipole component of the field is used for wobbling of electron beam 28 and the quadrupole component of the field is used for electron beam shape correction during wobbling. The angle of the split between segments 80, 82, 84, 86 in split lens 78 and the voltage applied to each segment during beam focusing/shaping can be selected so as to provide optimal focusing/shaping of electron beam 28.

Figure 8:
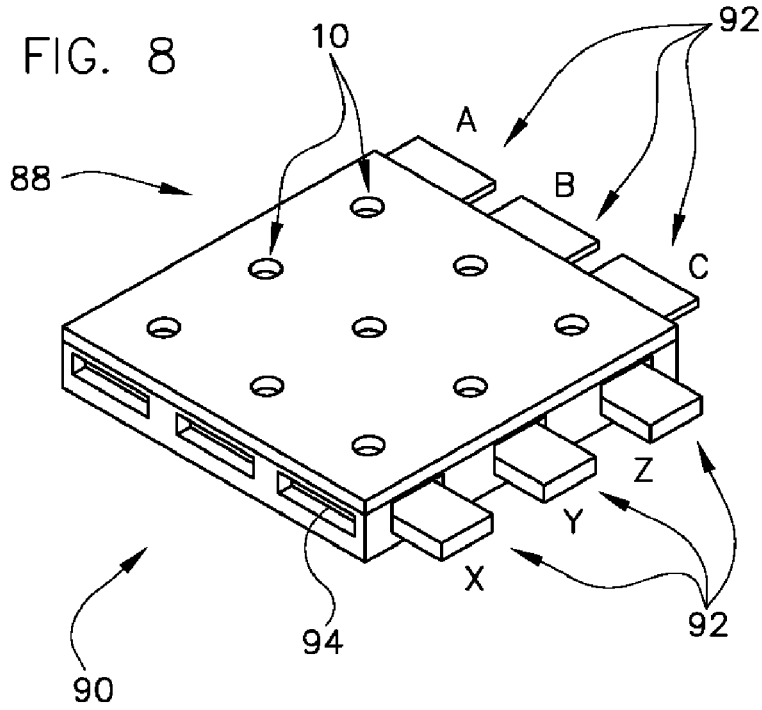
FIG. 8 is a pictorial view of a field emitter array in accordance with an embodiment of the present invention.

While shown as a single field emitter unit 10 in FIGS. 1-7, a plurality of field emitter units 10 can be arranged in a matrix to form a field emitter array 88 (i.e., electron generator matrix), thus providing an electron source (and multiple electron beam source locations) for a multiple spot x-ray source 90 (i.e., distributed x-ray source). Referring now to FIG. 8, a field emitter array 88 is depicted as a nine multiple spot x-ray source 90; however, it is realized that the number of field emitter units 10, and hence the size of the field emitter array 88, can vary depending on the application. Nine field emitter units 10 are arranged into a 3×3 array. Field emitter units 10 may be selectively turned ON and OFF to form the electron beams (not shown). The field emitter units 10 may be sequentially activated to effectively allow the electron beams to be sequentially generated or may be non-sequentially activated. The field emitter units 10 may be arbitrarily or randomly activated to improve image quality. The electron beams are emitted from the field emitter units 10 and are directed toward a target anode (not shown).

The field emitter array 88 has three rows, designated by X, Y, and Z, and three columns, designated by A, B, and C. The field emitter units 10 are activated or addressed by six activation connections 92 (i.e., voltage control channels), which are shared among field emitter units 10. Note that each field emitter unit 10 has two associated activation connections 92, one from rows X-Z and one from columns A-C. Thus, for a field emitter array 88 in this configuration, with N rows and N columns or $N^2$ elements, there are 2N (i.e., N+N) activation connections 92. As another example, a 900-emitter array in this configuration would utilize 60 activation connections. The activation connections 92 may be considered as 60 vacuum feedthrough lines.

Each activation connection 92 corresponding to a row X-Z of field emitter units 10 delivers an emitter voltage to an emitter element (see FIG. 1) in each field emitter unit 10 of the row. Each activation connection 92 corresponding to a column A-C of field emitter units 10 delivers an extraction voltage to an extraction electrode (see FIG. 1) in each field emitter unit 10 of the column. The voltage on the extraction electrode and emitter element in each field emitter unit 10 can be independently controlled as "High" and "Low." Thus, for example, to address a specific field emitter unit 94, a first specific emitter row X containing the specified emitter unit 94 is set to Low voltage and the other emitter rows Y-Z are set to High voltage. The extracting column C containing the specified emitter unit 94 is then set to High voltage and the rest of the extracting columns A-B are set to Low voltage, resulting in the specific field emitter unit 94 being addressed. In addition to independently controlling High and Low voltages in each row and column, the High and Low voltages themselves applied to each field emitter unit 10 can be individually controlled to modulate the electron beam current, which is a desirable feature for CT applications.

In addition to activation lines 92 configured to apply an emitter voltage and extraction voltage to each field emitter unit 10, it is also envisioned that a pair of common focusing lines (not shown) may be coupled to each field emitter unit 10 and the focusing electrode therein to control the width and length of the focal spot generated by each field emitter unit 10.

Figure 9:
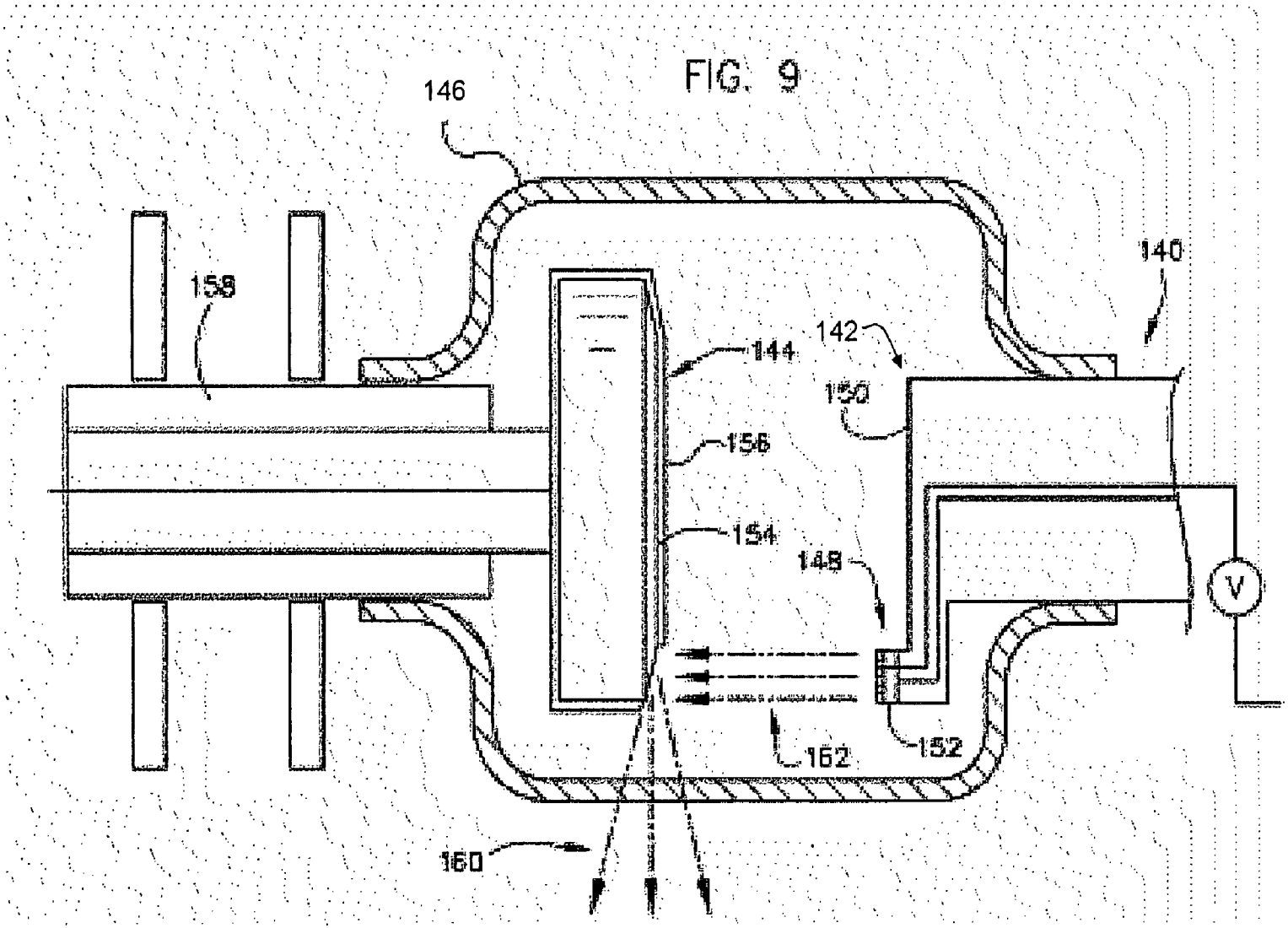
FIG. 9 is a schematic view of an x-ray source in accordance with an embodiment of the present invention.

Referring now to FIG. 9, an x-ray generating tube 140, such as for a CT system, is shown. Principally, x-ray tube 140 includes a cathode assembly 142 and an anode assembly 144 encased in a housing 146. Anode assembly 144 includes a rotor 158 configured to turn a rotating anode disc 154 and anode shield 156 surrounding the anode disc, as is known in the art. When struck by an electron current 162 from cathode assembly 142, anode 154 emits an x-ray beam 160 therefrom. Cathode assembly 142 incorporates an electron source 148 positioned in place by a support structure 150. Electron source 148 includes a field emitter array 152 to produce a primary electron current 162, as described in detail above. Further, with multiple electron sources, the target does not have to be a rotating target. Rather, it is possible to use a stationary target with electron beam is turned on sequentially from multiple cathodes. The stationary target can be cooled directly with oil, water, or another suitable liquid.

Figure 10:
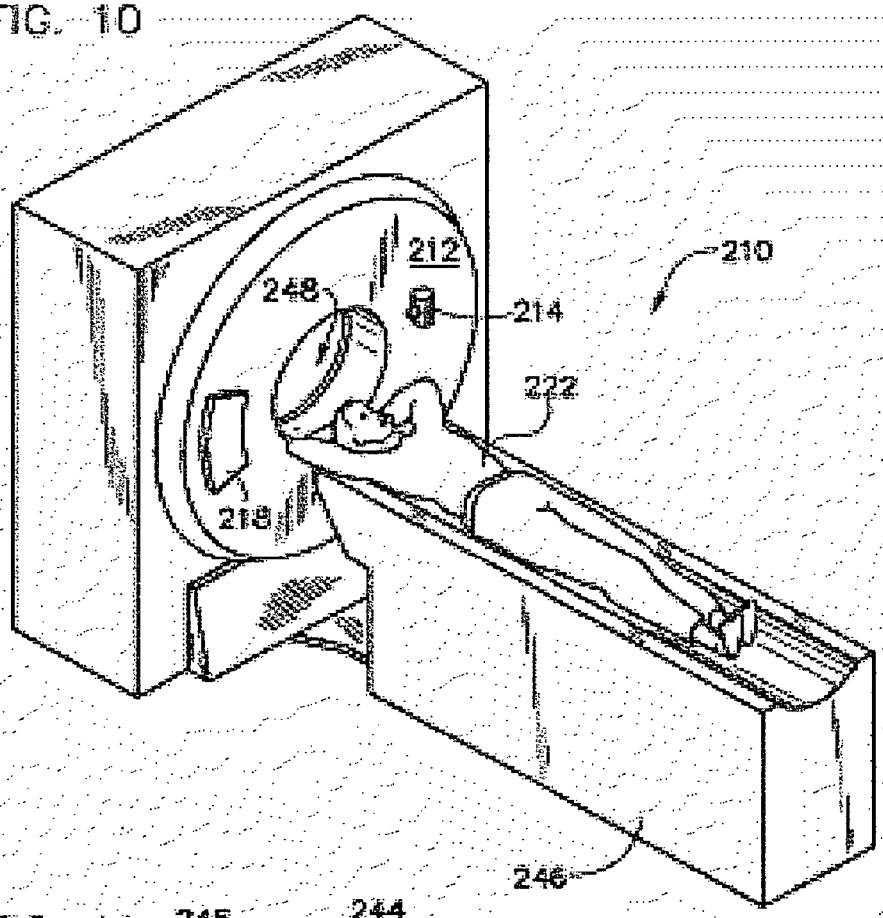
FIG. 10 is a perspective view of a CT imaging system incorporating an embodiment of the present invention.
Figure 11:
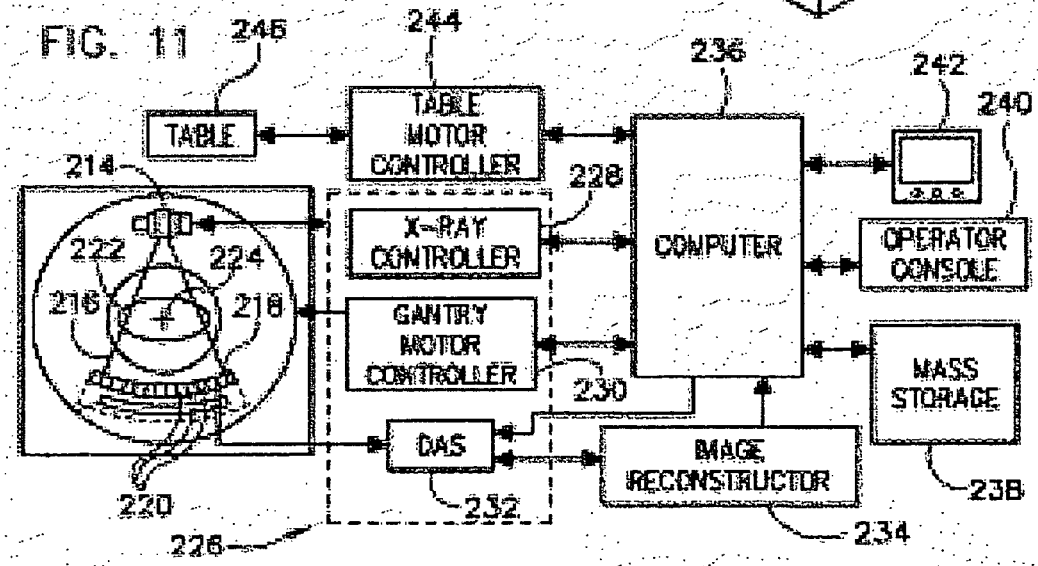
FIG. 11 is a schematic block diagram of the system illustrated in FIG. 10.

Referring to FIG. 10, a computed tomography (CT) imaging system 210 is shown as including a gantry 212 representative of a "third generation" CT scanner. Gantry 212 has an x-ray source 214 that rotates thereabout and that projects a beam of x-rays 216 toward a detector assembly 218 or collimator on the opposite side of the gantry 212. X-ray source 214 includes an x-ray tube having a field emitter based cathode constructed as in any of the embodiments described above. Referring now to FIG. 11, detector assembly 218 is formed by a plurality of detectors 220 and data acquisition systems (DAS) 232. The plurality of detectors 220 sense the projected x-rays that pass through a medical patient 222, and DAS 232 converts the data to digital signals for subsequent processing.

Each detector 220 produces an analog electrical signal that represents the intensity of an impinging x-ray beam and hence the attenuated beam as it passes through the patient 222. During a scan to acquire x-ray projection data, gantry 212 and the components mounted thereon rotate about a center of rotation 224.

Rotation of gantry 212 and the operation of x-ray source 214 are governed by a control mechanism 226 of CT system 210. Control mechanism 226 includes an x-ray controller 228 that provides power, control, and timing signals to x-ray source 214 and a gantry motor controller 230 that controls the rotational speed and position of gantry 212. X-ray controller 228 is preferably programmed to account for the electron beam amplification properties of an x-ray tube of the invention when determining a voltage to apply to field emitter based x-ray source 214 to produce a desired x-ray beam intensity and timing. An image reconstructor 234 receives sampled and digitized x-ray data from DAS 232 and performs high speed reconstruction. The reconstructed image is applied as an input to a computer 236 which stores the image in a mass storage device 238.

Computer 236 also receives commands and scanning parameters from an operator via console 240 that has some form of operator interface, such as a keyboard, mouse, voice activated controller, or any other suitable input apparatus. An associated display 242 allows the operator to observe the reconstructed image and other data from computer 236. The operator supplied commands and parameters are used by computer 236 to provide control signals and information to DAS 232, x-ray controller 228 and gantry motor controller 230. In addition, computer 236 operates a table motor controller 244 which controls a motorized table 246 to position patient 222 and gantry 212. Particularly, table 246 moves patients 222 through a gantry opening 248 of FIG. 10 in whole or in part.

Figure 12:
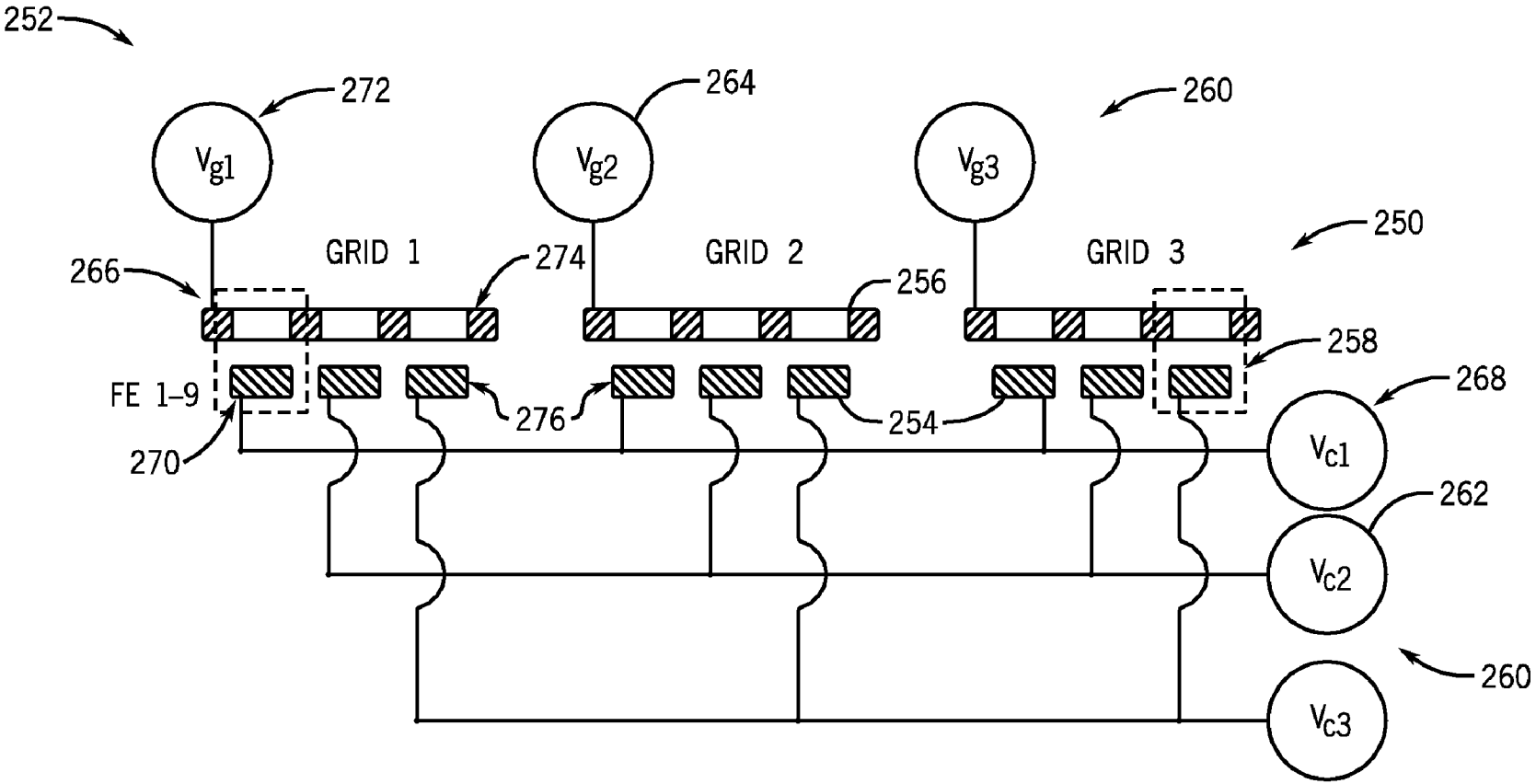
FIG. 12 is a schematic view of a field emitter array in accordance with another embodiment of the present invention.

Referring now to FIG. 12, in another embodiment, a field emitter array 250 is arranged in a "virtual matrix" arrangement to form a multi-spot electron beam generator 252. The virtual matrix is understood to comprise an emitter array 250 in which field emitter units are arranged in any arbitrary physical pattern or arrangement. More specifically, with respect to the invention, the virtual matrix arrangement of emitter array 250 includes field emitter units that are arranged in a non-rectangular (i.e., "non-matrixed") arrangement so as to not have a plurality of defined rows and columns. The virtual matrix addressing/activation scheme thus encompasses other physical arrangements and topologies besides standard square and/or rectangular arrays in which field emitters units are addressed by way of their row and column locations. The virtual matrix arrangement and addressing/activation scheme thus includes linear emitter arrays, semicircular emitter arrays, and other emitter array topologies.

As shown in FIG. 12, according to one embodiment of the virtual matrix arrangement and addressing/activation scheme, emitter array 250 is formed/arranged as a linear emitter array in which emitter elements 254 are linearly arranged into a 1×9 array. A plurality of meshed grids 256 are positioned adjacent to the emitter elements 254 for extracting an electron beam (not shown) therefrom, the meshed grids 256 and emitter elements 254 thus forming a plurality of field emitter units 258. A plurality of voltage control channels 260 are connected to the field emitter units 258 to apply voltages thereto and to activate and address individual field emitter units 258. Field emitter units 258 may be selectively turned ON and OFF to form electron beams based on the voltages applied thereto by voltage control channels 260. The field emitter units 258 may be sequentially activated to effectively allow the electron beams to be sequentially generated or may be non-sequentially activated. The field emitter units 258 may be arbitrarily or randomly activated to improve image quality. The electron beams are emitted from the field emitter units 258 and are directed toward a target anode (not shown).

To allow for the activation and addressing of individual field emitter units 258, a plurality of emitter control channels 262 and a plurality of grid control channels 264 (together forming voltage control channels 260) are included in multiple spot electron beam generator 252 to apply variable voltages to emitter elements 254 and meshed grids 256, respectively. That is, the voltages applied to emitter elements 254 and meshed grids 256 by emitter control channels 262 and grid control channels 264 can be independently controlled as "High" and "Low" to allow for activation of specified field emitter units 258. Thus, for example, to address a specific field emitter unit 266, an emitter control channel 268 connected to an emitter element 270 in specified emitter unit 266 is set to Low voltage. A grid control channel 272 connected to the specified emitter unit 266 is then set to High voltage so as to apply an extraction voltage to a meshed grid 274 included in specified emitter unit 266. Assuming that the extraction voltage applied by grid control channel 272 is sufficiently higher than the emission voltage applied by emitter control channel 268 (e.g., 1 kV), the specified field emitter unit 266 will be activated to emit an electron beam therefrom. Conversely, if the voltages applied to both the emitter element 270 and the meshed grid 274 are Low or if the voltage applied to the emitter element 270 is High and the voltage applied to the meshed grid 274 is Low, than the specified field emitter unit 266 will not be activated to emit an electron beam. Beneficially, it is understood that, in addition to independently controlling High and Low voltages to a specified field emitter unit, the High and Low voltages themselves applied to each field emitter unit 258 can be individually controlled to modulate the electron beam current, which is a desirable feature for CT applications.

According to the addressing/activation scheme of the virtual matrix arrangement, and as shown in FIG. 12, the linear array 250 of emitter elements 254 is divided into a number of emitter groups 276, with the number of emitter groups 276 being equal to the number of emitter control channels 262 included in multiple spot electron beam generator 252. Each emitter control channel 262 is connected to a single emitter element 254 from each of the emitter groups 276. Thus, as shown in the embodiment of FIG. 12, each emitter control channel 262 is connected to three emitter elements 254. As further shown in FIG. 12, a single meshed grid 256 corresponds to each emitter group 276. A grid control channel 264 is connected to each meshed grid 256 such that an extraction voltage can be applied across each emitter group 276. Thus, according to the above arrangement of the emitter elements 254 and meshed grids 256, and the connection of the emitter control channel 262 and grid control channel 264 thereto, each field emitter unit 258 can be individually addressed and activated.

For addressing/activating the emitter elements 254 in the virtual matrix arrangement, a design is implemented in which the number of voltage control channels 260 is equal to the sum of a pair of integers closest in value (i.e., having a minimum difference therebetween) whose product equals the number of emitter elements 254. Thus, for the 1×9 emitter array 250 shown in FIG. 12, the number of voltage control channels 260 is equal to the sum of three plus three (i.e., six connections). As additional examples, for a 1×30 emitter array, the number of voltage control channels would be equal to the sum of six plus five (i.e., eleven connections), and for a 1×500 emitter array, the number of voltage control channels would be equal to the sum of twenty plus twenty-five (i.e., forty-five connections). For the 1×9 linear array 250 in the embodiment of FIG. 12, there are thus three emitter control channels 262 and three grid control channels 264 used for supplying emission and extraction voltages to the emitter elements 254 and meshed grids 256, respectively. The above described addressing/activation scheme of the virtual matrix arrangement thus provides for a minimum number of total control channels 260 that are needed for individually controlling each field emitter unit 258.

Figure 13:
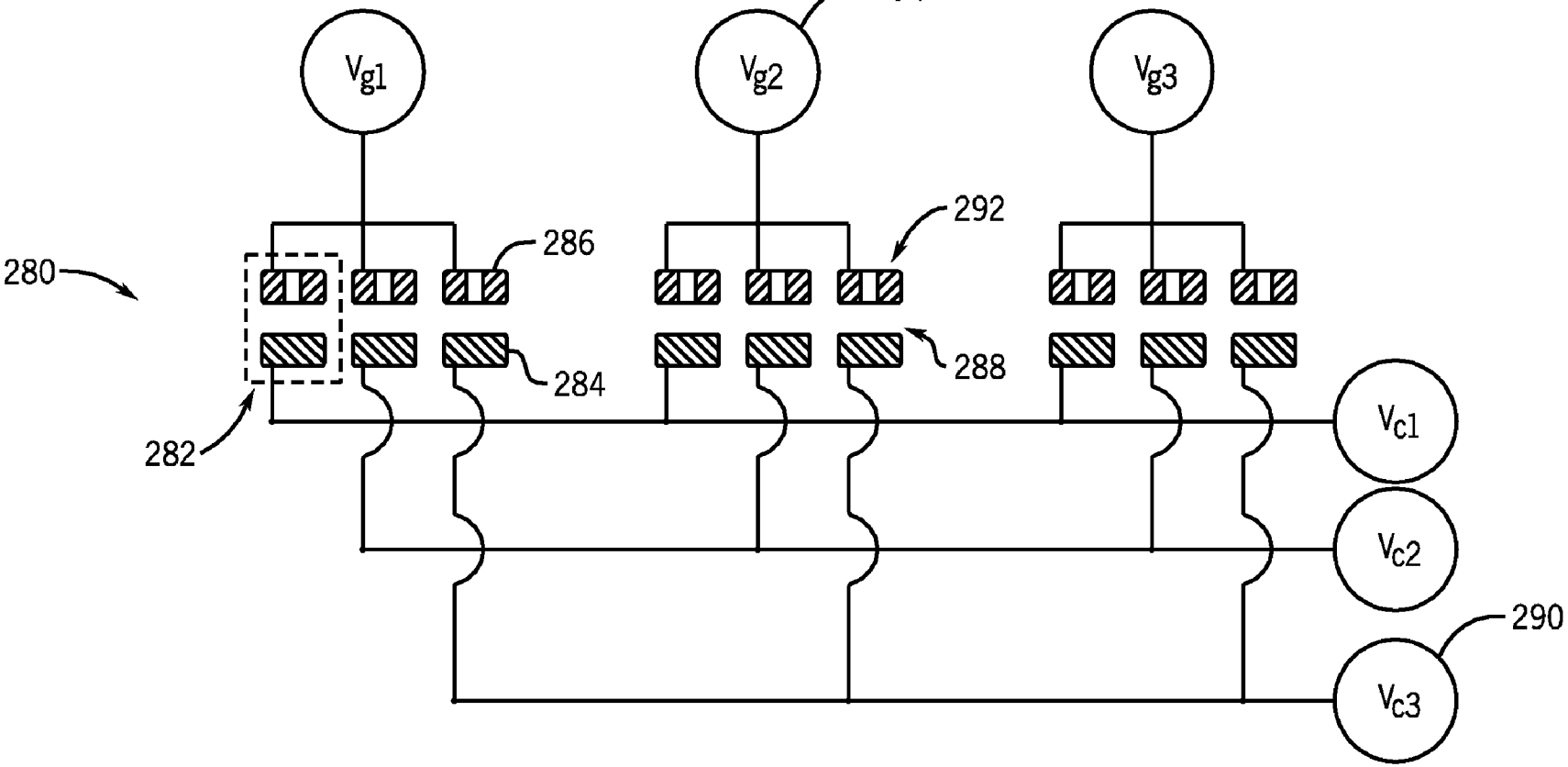
FIG. 13 is a schematic view of a field emitter array in accordance with another embodiment of the present invention.

Referring now to FIG. 13, according to another embodiment of the virtual matrix configuration and addressing/activation scheme, an array 280 of field emitter units 282 is comprised of a plurality of emitter elements 284 and a plurality of meshed grids 286. Each meshed grid 286 corresponds to a single emitter element 284, such that a plurality of individual field emitter units 282 are formed in the array 280. The formation of the individual field emitter units 282 with an individualized grid 286 corresponding to each emitter element 284 allows for the array 280 to be formed in a variety of arbitrary topologies. While array 280 is shown as a linear array, it is understood that the individual field emitter units 282 could also be arranged in a semi-circular emitter array or other non-patterned emitter array topology. Similar to the embodiment illustrated in FIG. 12, the emitter elements 284 and meshed grids 286 of the virtual matrix configuration illustrated in FIG. 13 are arranged into a plurality of groups 288. As set forth above, each emitter control channel is connected to a single emitter element from each of the emitter groups. Thus, as shown in the embodiment of FIG. 13, each emitter control channel 290 is connected to three emitter elements 284. As further shown in FIG. 13, a meshed grid 286 corresponds to each emitter element 284 in each emitter group 288, thus forming a grid group 292. A grid control channel 294 is connected to each grid group 292 such that an extraction voltage can be applied across each emitter group 288. Thus, according to the above arrangement of the emitter elements 284 and meshed grids 286 (and the arrangement thereof into groups 288, 292), and the connection of the emitter control channels 290 and grid control channels 294 thereto, each field emitter unit 282 can be individually addressed and activated. The number of voltage control channels 290, 294 needed for addressing/activating the individualized field emitter units 282 is equal to the sum of a pair of integers closest together whose product equals the number of emitter elements 284. This activation/addressing scheme allows for the use of a minimum number of voltage control channels 290, 294 needed for individually controlling each field emitter unit 282.

Figure 14:
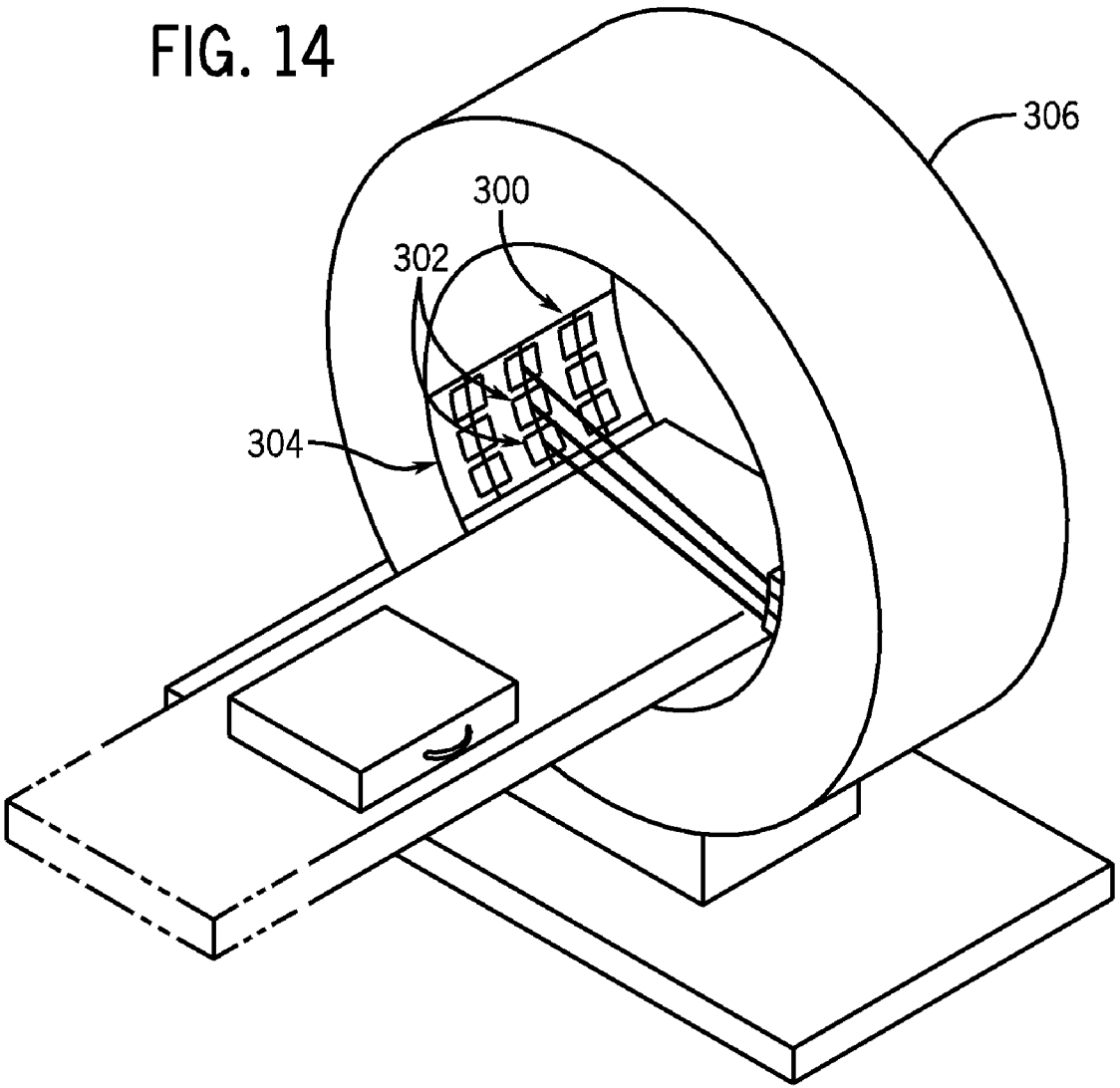
FIG. 14 is a perspective view of a distributed x-ray source included in a CT imaging system according to an embodiment of the present invention.

As shown in FIG. 14, it is envisioned that a linear array 300 of field emitter units 302 can be implemented for use as a distributed x-ray source 304 in a CT system 306. A single linear array 300 can form the distributed x-ray source 304 or, as shown in FIG. 14, a plurality of linear arrays 300 (e.g., three linear arrays) can be included in the distributed x-ray source 304 to broaden an area of coverage and/or increase versatility of CT system 306 for scanning. The implementation of distributed x-ray source 304 in CT system 306 allows for the CT system to comprise an inverse geometry CT system (IGCT) or a stationary x-ray source CT system.

While described with respect to a sixty-four-slice "third generation" computed tomography (CT) system, it will be appreciated by those skilled in the art that embodiments of the invention are equally applicable for use with other imaging modalities, such as electron gun based systems, x-ray projection imaging, package inspection systems, as well as other multi-slice CT configurations or systems or inverse geometry CT (IGCT) systems. Moreover, the invention has been described with respect to the generation, detection and/or conversion of x-rays. However, one skilled in the art will further appreciate that the invention is also applicable for the generation, detection, and/or conversion of other high frequency electromagnetic energy.

Therefore, according to one embodiment of the invention, a field emitter array system includes an emitter array comprising a plurality of emitter elements arranged in a non-rectangular layout and configured to generate at least one electron beam and a plurality of extraction grids positioned adjacent to the emitter array, each extraction grid being associated with at least one emitter element to extract the at least one electron beam therefrom. The field emitter array system also includes a plurality of voltage control channels connected to the plurality of emitter elements and the plurality of extraction grids such that each of the emitter elements and each of the extraction grids is individually addressable. In the field emitter array system, the number of voltage control channels is equal to a sum of a pair of integers closest in value whose product equals the number of emitter elements.

According to another embodiment of the invention, a multiple-spot electron beam generator includes a plurality of emitter groups that are linearly arranged, with each emitter group including a plurality of emitter elements. The multiple-spot electron beam generator also includes at least one extraction grid associated with, and positioned adjacent to, each emitter group and configured to extract an electron beam from at least one of the plurality of emitter elements associated therewith and a plurality of control channels coupled to the plurality of emitter elements and to the extraction grids associated with the emitter groups. The plurality of control channels includes a plurality of emitter control channels configured to deliver an emitter voltage, each emitter control channel connected to an emitter element from each of the plurality of emitter groups. The plurality of control channels also includes a plurality of grid control channels configured to deliver an extraction voltage, wherein each grid control channel corresponds to a respective emitter group and is connected to the at least one extraction grid adjacent to each emitter group. The quantity of emitter control channels and grid control channels is equal to a sum of a pair of integers having a minimum difference therebetween and whose product equals the number of emitter elements.

According to yet another embodiment of the invention, a distributed x-ray source for an imaging system includes a plurality of electron generators configured to emit at least one electron beam therefrom, with each electron generator comprising an emitter element and an extraction grid. The distributed x-ray source also includes a plurality of control circuits electrically connected to the plurality of electron generators such that each electron generator is connected to a pair of the control circuits to receive voltages therefrom, wherein a first control circuit of the pair of the control circuits is electrically connected to the emitter element and a second control circuit of the pair of control circuits is electrically connected to the extraction grid. The distributed x-ray source further includes a shielded anode positioned in a path of the at least one electron beam and configured to emit a beam of high-frequency electromagnetic energy conditioned for use in a CT imaging process when the electron beam impinges thereon. The number of control circuits in the distributed x-ray source is equal to a sum of a pair of integers closest in value whose product equals the number of emitter elements.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A field emitter array system comprising:

an emitter array comprising a plurality of emitter elements arranged in a non-rectangular layout and configured to generate at least one electron beam, wherein the plurality of emitter elements is divided into a plurality of emitter groups, each emitter group comprising a respective portion of the plurality of emitter elements therein;

a plurality of extraction grids positioned adjacent to the emitter array, wherein each of the plurality of extraction grids is associated with an emitter group from the plurality of emitter groups to extract the at least one electron beam from at least one of the plurality of emitter elements associated therewith; and a plurality of voltage control channels connected to the plurality of emitter elements and the plurality of extraction grids such that each of the emitter elements and each of the extraction grids is individually addressable;

wherein the number of voltage control channels is equal to a sum of a pair of integers closest in value whose product equals the number of emitter elements.

2. The field emitter array system of claim 1 wherein the emitter array comprises a linear emitter array.

3. The field emitter array system of claim 1 wherein the plurality of voltage control channels comprises a plurality of emitter control channels and a plurality of grid control channels.

4. The field emitter array system of claim 3 wherein each of the plurality of emitter groups comprises at least a first emitter element and a second emitter element and wherein a first emitter control channel is connected to the first emitter element in each of the plurality of emitter groups and a second emitter control channel is connected to the second emitter element in each of the plurality of emitter groups.

5. The field emitter array system of claim 3 further comprising a controller, wherein each of the plurality of extraction grids is controlled via a single grid control channel.

6. The field emitter array system of claim 3 further comprising a voltage source, wherein each of the plurality of emitter control channels is configured to deliver a variable emitter voltage to each emitter element coupled thereto and wherein each of the plurality of grid control channels is configured to deliver a variable grid voltage to each extraction grid coupled thereto.

7. The field emitter array system of claim 6 wherein an emitter element is caused to emit the electron beam therefrom when the grid voltage delivered to the extraction grid associated with the emitter element is greater than the emitter voltage delivered to the emitter element by the emitter control channel.

8. The field emitter array of claim 1 incorporated into a distributed x-ray source, the distributed x-ray source including a shielded anode positioned in a path of the at least one electron beam and configured to emit a beam of high-frequency electromagnetic energy conditioned for use in a CT imaging process when the electron beam impinges thereon.

9. A multiple-spot electron beam generator comprising:

a plurality of emitter groups linearly arranged, each emitter group including a plurality of emitter elements arranged in a non-rectangular, non-matrixed array;

at least one extraction grid associated with and positioned adjacent to each emitter group and configured to extract an electron beam from at least one of the plurality of emitter elements associated therewith;

a plurality of control channels coupled to the plurality of emitter elements and to the extraction grids associated with the emitter groups, the plurality of control channels comprising:

a plurality of emitter control channels configured to deliver an emitter voltage, each emitter control channel connected to an emitter element from each of the plurality of emitter groups; and a plurality of grid control channels configured to deliver an extraction voltage, wherein each grid control channel corresponds to a respective emitter group and is connected to the at least one extraction grid adjacent to each emitter group, wherein the quantity of emitter control channels and grid control channels is equal to a sum of a pair of integers having a minimum difference therebetween and whose product equals the number of emitter elements.

10. The multiple-spot electron beam generator of claim 9 wherein the plurality of emitter elements are arranged to form a linear array.

11. The multiple-spot electron beam generator of claim 9 wherein the at least one extraction grid positioned adjacent to each emitter group comprises a plurality of extraction grids, each of the plurality of extraction grids corresponding to a single emitter element in the emitter group.

12. The multiple-spot electron beam generator of claim 9 further comprising a controller, wherein each of the plurality of emitter control channels and each of the plurality of grid control channels are configured to selectively provide a high voltage signal and a low voltage signal; and wherein at least one of the plurality of emitter elements is activated upon receiving the high voltage signal from one of the plurality of grid control channels and upon receiving the low voltage signal from one of the plurality of emitter control channels.

13. A distributed x-ray source for an imaging system comprising:

a plurality of electron generators configured to emit at least one electron beam therefrom, the plurality of electron generators comprising:

a plurality of emitter groups linearly arranged, each emitter group including a plurality of emitter elements arranged in a non-rectangular array;

at least one extraction grid associated with and positioned adjacent to each emitter group and configured to extract an electron beam from at least one of the plurality of emitter elements associated therewith, wherein the plurality of electron generators are arranged in a non-rectangular arrangement so as to not have a plurality of defined rows and columns;

a plurality of control circuits electrically connected to the plurality of electron generators such that each electron generator is connected to a pair of the control circuits to receive voltages therefrom, wherein a first control circuit of the pair of the control circuits is electrically connected to the emitter element and a second control circuit of the pair of control circuits is electrically connected to the extraction grid; and a shielded anode positioned in a path of the at least one electron beam and configured to emit a beam of high-frequency electromagnetic energy conditioned for use in a CT imaging process when the electron beam impinges thereon, wherein the plurality of control circuits comprises a number of control circuits equal to a sum of a pair of integers closest in value whose product equals the number of emitter elements.

14. The distributed x-ray source of claim 13 wherein the plurality of electron generators are arranged in a linear array.

15. The distributed x-ray source of claim 14 further comprising at least one additional linear array of electron generators.

16. The distributed x-ray source of claim 13 wherein each of the plurality of electron generators is individually addressable by a pair of control circuits to emit the electron beam therefrom.

17. The distributed x-ray source of claim 13 further comprising a controller, wherein an electron generator in the plurality of electron generators is activated to emit the electron beam when a second voltage provided by the second control circuit is greater than a first voltage provided by the first control circuit.

18. The distributed x-ray source of claim 17 wherein the first voltage and the second voltage is variable between each control circuit in the plurality of control circuits.

* * * * *

UNITED STATES PATENT AND TRADEMARK OFFICE

CERTIFICATE OF CORRECTION

PATENT NO. : 7,826,594 B2
APPLICATION NO. : 12/113726
DATED : November 2, 2010
INVENTOR(S) : Zou et al.

It is certified that error appears in the above-identified patent and that said Letters Patent is hereby corrected as shown below:

In Column 13, Line 62, in Claim 8, after “array”, insert -- system --.

Signed and Sealed this
Twenty-eighth Day of December, 2010

David J. Kappos

David J. Kappos
*Director of the United States Patent and Trademark Office*